US009341046B2

(12) United States Patent
Huh et al.

(10) Patent No.: US 9,341,046 B2
(45) Date of Patent: May 17, 2016

(54) APPARATUS CONFIGURATION DOWNHOLE

(71) Applicant: Schlumberger Technology Corporation, Sugar Land, TX (US)

(72) Inventors: Michael Huh, Pearland, TX (US); Partha Ganguly, Sugar Land, TX (US); Jake A. Danos, Houston, TX (US); Jessica Schulte, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 519 days.

(21) Appl. No.: 13/677,629

(22) Filed: Nov. 15, 2012

(65) Prior Publication Data

US 2013/0319687 A1 Dec. 5, 2013

Related U.S. Application Data

(60) Provisional application No. 61/654,972, filed on Jun. 4, 2012.

(51) Int. Cl.

| | |
|---|---|
| ***E21B 34/12*** | (2006.01) |
| ***E21B 34/14*** | (2006.01) |
| ***E21B 43/14*** | (2006.01) |
| ***E21B 33/124*** | (2006.01) |
| *E21B 23/02* | (2006.01) |
| *E21B 43/08* | (2006.01) |

(52) U.S. Cl.

CPC ..... *E21B 34/14* (2013.01); *E21B 33/124* (2013.01); *E21B 43/14* (2013.01); *E21B 23/02* (2013.01); *E21B 43/088* (2013.01)

(58) Field of Classification Search

CPC ..... E21B 23/00; E21B 34/14; E21B 34/12; E21B 34/16

USPC ..... 166/242.1, 242.5, 334.1, 334.4

See application file for complete search history.

(56) References Cited

U.S. PATENT DOCUMENTS

| | | | | |
|---|---|---|---|---|
| 2,277,380 | A * | 3/1942 | Yancey | 166/74 |
| 2,920,764 | A * | 1/1960 | Hodges | 508/283 |
| 3,073,392 | A * | 1/1963 | Dinning et al. | 166/332.4 |
| 3,115,188 | A * | 12/1963 | Cochran et al. | 166/332.4 |
| 3,768,556 | A | 10/1973 | Baker | |
| 3,789,926 | A | 2/1974 | Henley et al. | |
| 4,280,561 | A | 7/1981 | Fredd | |
| 4,415,038 | A * | 11/1983 | Schmuck | 166/373 |

(Continued)

OTHER PUBLICATIONS

International Search Report and Written Opinion mailed on Aug. 20, 2013 for International Patent Application No. PCT/US2013/040833, filed on May 14, 2013, 13 pages.

*Primary Examiner* — Kenneth L Thompson

(74) *Attorney, Agent, or Firm* — Jeffery R. Peterson

(57) ABSTRACT

A method comprising moving a shifting tool in a first direction through a moveable member positioned in a casing of a wellbore, including moving the shifting tool through a shifting tool interface member (STIM) adjacent the moveable member, until the shifting tool is positioned past the moveable member and the STIM. The shifting tool is then moved in a second direction substantially opposite the first direction until the shifting tool and the STIM engage. The shifting tool is then further moved in the second direction, thereby moving the STIM and the moveable member in the second direction, until the STIM substantially simultaneously (1) engages the casing and (2) disengages the shifting tool.

20 Claims, 8 Drawing Sheets

(56) References Cited

U.S. PATENT DOCUMENTS

| | | | | |
|---|---|---|---|---|
| 4,436,152 | A | 3/1984 | Fisher, Jr. et al. | |
| 4,729,433 | A * | 3/1988 | Jacob | 166/322 |
| 4,991,653 | A | 2/1991 | Schwegman | |
| 4,991,654 | A | 2/1991 | Brandell et al. | |
| 5,641,023 | A * | 6/1997 | Ross et al. | 166/386 |
| 5,676,208 | A * | 10/1997 | Finley | 166/278 |
| 6,513,595 | B1 | 2/2003 | Freiheit et al. | |
| 6,776,238 | B2 | 8/2004 | Dusterhoft et al. | |
| 7,108,067 | B2 | 9/2006 | Themig et al. | |
| 7,150,326 | B2 * | 12/2006 | Bishop et al. | 166/373 |
| 7,267,172 | B2 | 9/2007 | Hofman | |
| 7,387,165 | B2 | 6/2008 | Lopez de Cardenas et al. | |
| 7,431,091 | B2 | 10/2008 | Themig et al. | |
| 7,712,538 | B2 | 5/2010 | Fay | |
| 7,971,646 | B2 * | 7/2011 | Murray et al. | 166/332.4 |
| 2007/0272411 | A1 | 11/2007 | Lopez de Cardenas et al. | |
| 2009/0084553 | A1 | 4/2009 | Rytlewski et al. | |
| 2011/0056692 | A1 | 3/2011 | Lopez de Cardenas et al. | |
| 2011/0198096 | A1 * | 8/2011 | Mailand et al. | 166/373 |
| 2012/0048559 | A1 | 3/2012 | Ganguly et al. | |
| 2012/0067583 | A1 | 3/2012 | Zimmerman et al. | |
| 2012/0080190 | A1 | 4/2012 | Rytlewski | |

* cited by examiner

APPARATUS CONFIGURATION DOWNHOLE

CROSS-REFERENCE TO RELATED APPLICATIONS

This application claims the benefit of U.S. Provisional Application No. 61/654,972, entitled "METHOD AND DEVICE FOR SHIFTING COMPONENTS IN MULTI-ZONE VALVE SYSTEMS," filed Jun. 4, 2012, the entire disclosure of which is hereby incorporated herein by reference.

BACKGROUND OF THE DISCLOSURE

Completion sequences often involve running in an assembly of screens with a crossover tool and an isolation packer above the crossover tool. The crossover tool has a squeeze position where it eliminates a return path to allow fluid pumped down a work string and through the packer to cross over to the annulus outside the screen sections and into the formation through, for example, a cemented and perforated casing. Alternatively, the casing could have telescoping members that are extendable into the formation and the tubular from which they extend could be cemented or not cemented. The fracture fluid, in any event, would go into the annular space outside the screens and get squeezed into the formation that is isolated by the packer above the crossover tool and another downhole packer or the bottom of the hole. When a particular portion of a zone is fractured in this manner, the crossover tool is repositioned to allow a return path, usually through the annular space above the isolation packer and outside the work string, so that a gravel packing operation could then begin. In the gravel packing operation, the gravel exits the crossover tool to the annular space outside the screens. Carrier fluid goes through the screens and back into the crossover tool to get through the packer above and into the annular space outside the work string and back to the surface. This entire procedure is repeated if another well zone is to be fractured and gravel packed before it can be produced. Once a given well zone is gravel packed, the production string is tagged into the packer and the well zone is produced.

Aspects of this technique include the rig time required for running in the hole and conducting the discrete operations, the erosive qualities of the gravel slurry during deposition of gravel in the gravel packing procedure, and wear of portions of the crossover tool during the fracking operation or the subsequent gravel packing operation. These aspects are magnified if more than one well zone is to be fractured and gravel packed, including additional trips in the hole with more screens coupled to a crossover tool and an isolation packer and a repeating of the process.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
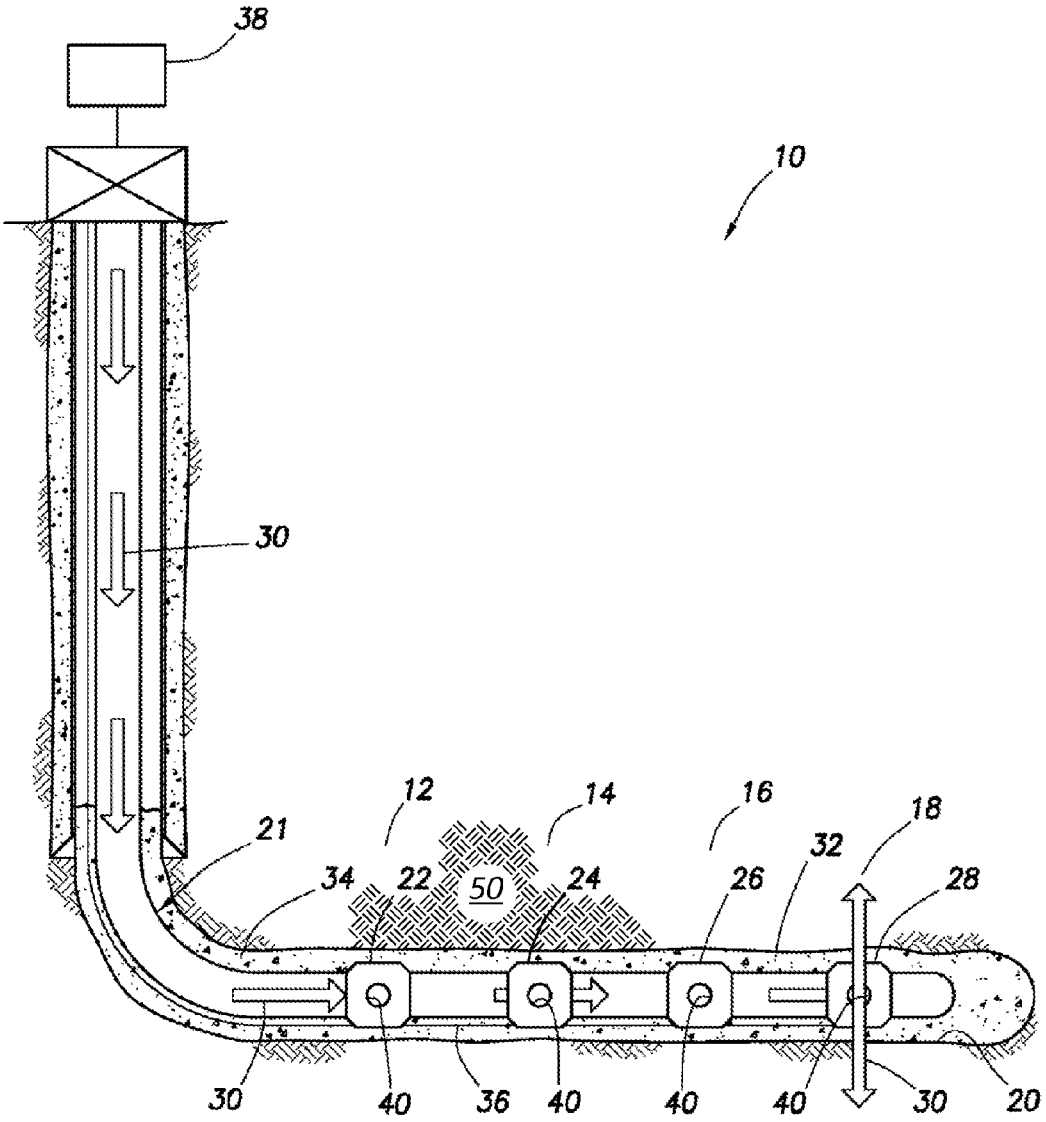
FIG. 1 is a schematic view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and may or may not in itself dictate a relationship between the various embodiments and/or configurations discussed herein.

FIG. 1 is a schematic view of a system 10 according to one or more aspects of the present disclosure. The system 10 may be one of several environments in which one or more aspects of one or more apparatus may be implemented within the scope of the present disclosure, and/or in which one or more aspects of one or more methods may be executed within the scope of the present disclosure. Thus, while the system 10 is described in detail herein, and other aspects of the present disclosure and figures may be described below in the context of the system 10 shown in FIG. 1, other systems not identical to the system 10 shown in FIG. 1 are also within the scope of the present disclosure.

Like other apparatus and methods within the scope of the present disclosure, the system 10 may be used to selectively stimulate one or more well zones 12, 14, 16 and 18 of a subterranean formation 50 intersected by a wellbore 20. As depicted in FIG. 1, there are four well zones 12, 14, 16 and 18, and the wellbore 20 is substantially horizontal as it extends through the well zone, but it should be clearly understood that any number of well zones may exist, and the wellbore 20 could be vertical or inclined in any direction when extending through the well zones, yet such scenarios are still within the scope of the present disclosure.

A casing 21 is installed in the wellbore 20. As used herein, the term "casing" indicates any tubular and/or string of tubulars used, for example, to form a protective lining for the wellbore 20. The casing 21 may be made of any material, such as steel, polymers and composite materials, among others, and may be jointed, segmented or continuous. The casing 21 may be sealed to the surrounding formation 50 using cement, epoxy and/or another hardenable materials 32 (collectively referred to herein as cement 32), and/or using packers or other sealing materials, to prevent or isolate axial (relative to the axis or centerline of the wellbore 20) fluid communication through an annulus 34 formed between the casing 21 and the wellbore 20.

The casing 21 depicted in FIG. 1 comprises four valves 22, 24, 26 and 28 interconnected therein. The valves 22, 24, 26 and 28, which may be part of the casing 21, are axially spaced apart at regular or irregular along the casing 21. For example, the valves 22, 24, 26 and 28 may each be discrete components connected to the casing 21 via threaded coupling and/or other means, although one or more of the valves 22, 24, 26 and 28 may be integrally formed with a portion of the casing 21. As also shown in FIG. 1, each of the valves 22, 24, 26 and 28 corresponds to one of the well zones 12, 14, 16 and 18, and is positioned in the wellbore 20 adjacent or opposite the corresponding well zone. However, it should be understood that any number of valves may be utilized in keeping with the principles introduced in the present disclosure, and it is not necessary for a single valve to correspond to a single well zone. For example, multiple valves could correspond to, and thus be positioned adjacent or proximate to, a single well zone, and a single valve could correspond to, and be positioned opposite, multiple well zones.

Each of the valves 22, 24, 26 and 28 is selectively operable to permit and prevent fluid flow between an interior and exterior of the casing 21. The valves 22, 24, 26 and 28 may also control flow between the interior and exterior of the casing 21 by variably choking or otherwise regulating such flow.

With the valves 22, 24, 26 and 28 positioned adjacent or proximate the respective well zones 12, 14, 16 and 18 as depicted in FIG. 1, the valves may also be configured downhole, according to one or more aspects of the present disclosure, to selectively control flow between the interior of the casing 21 and each of the well zones. For example, each of the well zones 12, 14, 16 and 18 may be selectively stimulated by flowing stimulation fluid 30 through the casing 21 and through any of the open valves into the corresponding well zones.

As used herein, the term "stimulation fluid" indicates any fluid or combination of fluids injected into the formation 50 or well zone 12, 14, 16 and/or 18 to increase a rate of fluid flow through the formation or well zone. For example, a stimulation fluid might be used to fracture the formation 50, to deliver proppant to fractures in the formation, to acidize the formation, to heat the formation, and/or to otherwise increase the mobility of fluid in the formation. Stimulation fluid may include various components, including gels, proppants and breakers, among others. However, the fluid 30 may also or alternatively be or comprise some type of treatment fluid other than stimulation fluid.

As depicted in FIG. 1, the stimulation or treatment fluid 30 is being delivered to the well zone 18 via the open valve 28 while the remaining valves 22, 24 and 26 are closed. In this manner, the well zone 18 can be selectively treated (e.g., stimulated by fracturing, acidizing and/or other means) without substantially affecting the remaining well zones 12, 14 and 16. That is, the well zone 18 is isolated from the well zone 16 in the wellbore 20 by the cement 32 in the annulus 34 between the casing 21 and the wellbore 20. The cement 32 prevents the stimulation or treatment fluid 30 from flowing into the well zone 16 via the wellbore 20 when stimulation or treatment of the well zone 16 is not desired. The cement 32 isolates each of the well zones 12, 14, 16 and 18 from each other in the wellbore 20.

As used herein, the term "cement" indicates a hardenable sealing substance which is initially sufficiently fluid to flow into a cavity in a wellbore, but which subsequently hardens or "sets up" so that it seals off the cavity. Some cement within the scope of the present disclosure may harden when hydrated. Other types of cement within the scope of the present disclosure (e.g., epoxies and/or other polymers) may harden due to passage of time, application of heat and/or a combination of certain chemical components, among other methods.

Each of the valves 22, 24, 26 and 28 has one or more ports 40 for providing fluid communication through a sidewall of the valve. It is contemplated that the cement 32 may prevent flow between the ports 40 and the well zones 12, 14, 16 and 18 after the cement has hardened, such that various measures may be employed to either prevent the cement from blocking this flow, or to remove the cement from the ports, and from between the ports and the well zones. For example, the cement 32 may be a soluble cement (such as an acid soluble cement), and the cement in the ports 40 and between the ports and the well zones 12, 14, 16 and 18 may be dissolved by a suitable solvent to permit the stimulation or treatment fluid 30 to flow into the well zones. The fluid 30 may also or alternatively be such a solvent, perhaps in lieu of introducing any other solvent.

The valve 28 is opened after the cement 32 has hardened to seal off the annulus 34 between the well zones 12, 14, 16 and 18. The fluid 30 may then be pumped through the casing 21 and into the well zone 18.

The valve 28 is then closed, and the next valve 26 is opened. The fluid 30 may then be pumped through the casing 21 and into the well zone 16. The valve 26 is then closed, and the next valve 24 is opened. The fluid 30 may then be pumped through the casing 21 and into the well zone 14. The valve 24 is then closed, and the next valve 22 is opened. The fluid 30 may then be pumped through the casing 21 and into the well zone 12.

Thus, the valves 22, 24, 26 and 28 may be sequentially opened and then closed to permit sequential stimulation or other treatment of the corresponding well zones 12, 14, 16 and 18. However, it should be noted that the valves 22, 24, 26 and 28 may be opened and closed in any order within the scope of the present disclosure, although such operation may require more than one shifting tool and/or shifting tool interface member (STIM), both of which are described below.

After the above-described operation, it may be desired to test the well zones 12, 14, 16 and 18 to determine, for example, permeability, productivity and injectivity, among other characteristics. One of the well zones 12, 14, 16 and 18 may be tested by opening the corresponding one of the valves 22, 24, 26 and 28 while the other valves are closed. Formation tests, such as buildup and drawdown tests, may also be performed for each well zone 12, 14, 16 and 18 by selectively opening and closing the corresponding one of the valves 22, 24, 26 and 28 while the other valves are closed. Instruments such as pressure and temperature sensors may be included (e.g., within the casing 21) to perform downhole measurements during these tests.

The valves 22, 24, 26 and 28 may also be useful during production to control the rate of production from each well zone 12, 14, 16 and 18. For example, if the well zone 18 should begin to produce water, the corresponding valve 28 could be closed, or flow through the valve could be choked, to reduce the production of water.

If the well is an injection well, the valves 22, 24, 26 and 28 may be useful to control placement of an injected fluid (such as water, gas, steam, etc.) into the corresponding well zones 12, 14, 16 and 18. A waterflood, steamfront, oil-gas interface and/or other injection profile may be manipulated by controlling the opening, closing or choking of fluid flow through the valves 22, 24, 26 and 28.

Figure 2:
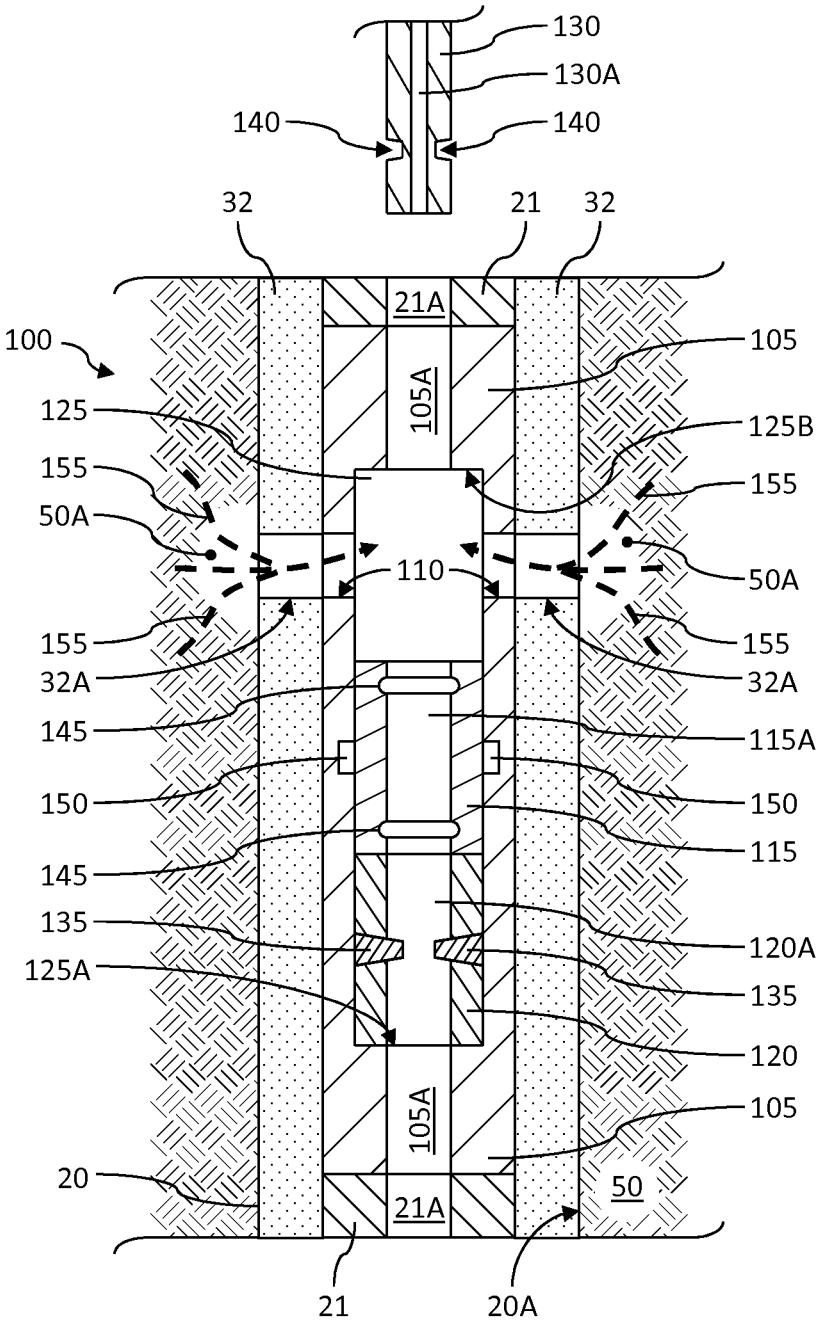
FIG. 2 is a schematic view of a portion of apparatus according to one or more aspects of the present disclosure.

FIG. 2 is a schematic sectional view of a valve 100 which may be used for any of the valves 22, 24, 26 and 28 in the system 10 shown in FIG. 1. The valve 100 may also be used in other systems without departing from the principles of the present disclosure.

The valve 100 comprises a body, housing and/or other component or assembly 105 (hereafter collectively referred to as housing 105) configured to be coupled in series with one or more sections of the casing 21. The housing 105 may also be or comprise a portion of the casing 21, such that any reference herein to the housing 105 may also be applicable or readily adaptable to the casing 21, and in some instances herein the housing 105 and casing 21 may be considered as interchangeable terms for the same apparatus. In other embodiments explicitly described herein or otherwise within the scope of the present disclosure, the housing 105 may be or comprise a housing and/or other component or assembly (not shown) coupled to the casing 21, perhaps in a manner by which the exterior profiles of the casing 21 and the housing 105 are substantially continuous and/or have substantially similar or identical diameters.

The valve 100 and casing 21 are also shown in FIG. 2 as being secured in the wellbore 20 by cement 32, perhaps in a manner similar to that described above with respect to FIG. 1. The cement 32 includes openings 32A adjacent ports 110 of the valve. The openings 32A may be formed after the cement 32 has hardened, such as via pressurized fluid received from the surface via an internal passage 21A of the casing and an internal passage 105A of the valve housing 105, whereby the pressurized fluid etches away or otherwise removes that portion of the cement 32 adjacent the ports 110. Alternatively, the openings 32A in the cement 32 may be formed by telescopic and/or cylindrical members (not shown) adjacent the ports 110 that extend from the valve 100 to the sidewall 20A of the wellbore 20 during the cementing operation, thus forming the openings 32A as part of the cementing operation via preventing cement from flowing into the desired location of the openings. Of course, other methods of forming the openings 32A are also within the scope of the present disclosure.

The valve 100 also comprises a moveable member 115 and a shifting tool interface member (STIM) 120 each contained within the housing 105. The moveable member 115 and the STIM 120 are each moveable within an internal cavity 125 of the housing 105. For example, the moveable member 115 and the STIM 120 may each have a substantially cylindrical cross-sectional shape and the internal cavity 125 of the housing 105 may also have a substantially cylindrical cross-sectional shape configured to receive and permit axial movement of the moveable member 115 and the STIM 120 within the housing 105. The cross-sectional diameter of the internal cavity 125 may be substantially larger than that of the internal passage 105A of the housing 105 and/or the internal passage 21A of the casing 21, although the scope of the present disclosure is not limited to such embodiments.

In the illustration of FIG. 2, the bottom of the wellbore 20 may be in a downward direction relative to the page, although the axial direction of the wellbore 20 may actually be far from vertical (perhaps even horizontal). Nonetheless, as shown in FIG. 2, the STIM 120 may be positioned "below" the moveable member 115, such that the STIM 120 may be situated between the moveable member 115 and the bottom of the wellbore 20. However, one or more aspects of the present disclosure are applicable or readily adaptable to other embodiments within the scope of the present disclosure in which the STIM 120 is positioned "above" the moveable member 115, such that the moveable member 115 is situated between the STIM 120 and the bottom of the wellbore 20.

The STIM 120 comprises an internal passage 120A configured to receive and interface with a shifting tool 130 run in from the surface of the wellbore 20. A portion of the shifting tool 130 is depicted in FIG. 2 as being positioned above the valve 100, i.e., not yet run into the wellbore 20. The shifting tool 130 may have a substantially cylindrical or other cross-sectional shape configured such that the shifting tool 130 can be run into the internal passage 21A of the casing 21 and the internal passage 105A of the housing 100. The shifting tool 130 optionally comprises an internal passage 130A, such as to permit the flow of fluid from the surface to the valve 100 (or to some other component or position in the valve 100, the casing 21 and/or the wellbore 20).

Although many configurations by which the shifting tool 130 and the STIM 120 may interface are within the scope of the present disclosure, the example shown in FIG. 2 depicts the STIM 120 as comprising an internal passage 120A having an internal profile that comprises at least portions of features 135 that are configured to interface with corresponding features 140 of the shifting tool 130. Specific examples of these features 135 and 140 and how they permit the desired interface between the STIM 120 and the shifting tool 130 are described further below.

The moveable member 115 comprises an internal passage 115A having an internal profile configured to allow the shifting tool 130 to pass unencumbered through the internal passage 115A to the STIM 120. However, the internal profile of the moveable member 115 may comprise features 145 configured to interface with a different shifting tool (not shown) yet still permit the shifting tool 130 to pass unencumbered.

The cross-sectional shapes and/or areas of the internal passage 115A of the moveable member 115 and the internal passage 120A of the STIM 120 may be substantially similar and, as depicted in FIG. 2, may be substantially similar to the cross-sectional shape and/or area of the internal passage 105A of the housing 105 and/or the internal passage 21A of the casing 21. For example, each of these internal passages 115A, 120A, 105A and 21A may have substantially similar, substantially circular cross-sectional shapes having a diameter large enough to allow substantially unencumbered passage of the shifting tool 130. However, other configurations are also within the scope of the present disclosure.

The housing 105 also comprises one or more features 150 that individually or collectively permitting engagement between the STIM 120 and the housing 105 when the STIM 120 is axially translated or otherwise shifted within the housing 105 towards the features 150. Although many configurations by which the STIM 120 and the housing 105 may engage are within the scope of the present disclosure, the example shown in FIG. 2 depicts the features 150 as being recesses sized to receive at least portions of the features 135 of the STIM 120. This and other examples of the features 135 and 150 and how they permit the desired interface between the STIM 120 and the housing 105 are described further below.

The configuration of the valve 100 shown in FIG. 2 is an example of an initial configuration utilized in one or more methods described herein or otherwise within the scope of the present disclosure. That is, the STIM 120 may be positioned at the lower end 125A of the internal cavity 125 of the housing 105, and the moveable member 115 may be positioned immediately adjacent the STIM 120, such that the ports 110 of the valve 100 are open to the wellbore 200. For example, in the configuration of the valve 100 shown in FIG. 2, a flow path 155 exists between the formation 50 and the interior cavity 125 of the housing 105. FIG. 2 also depicts that a portion 50A of the formation 50 has been treated via pressurized fluid delivered through the ports 110, such as via one or more fracturing and/or other treatment operations. However, another example of an initial configuration utilized in one or more methods described herein or otherwise within the scope of the present disclosure comprises the STIM 120 positioned at the lower end 125A of the internal cavity 125 but the moveable member 115 is positioned away from the STIM 120, perhaps even as far away as being in contact with an upper end 125B of the internal cavity 125, or perhaps in some other position between the STIM 120 and the upper end 125B of the internal cavity 125. Thus, the moveable member 115 may initially close the ports 110, which substantially or entirely interrupts the flow path 155.

Figure 3:
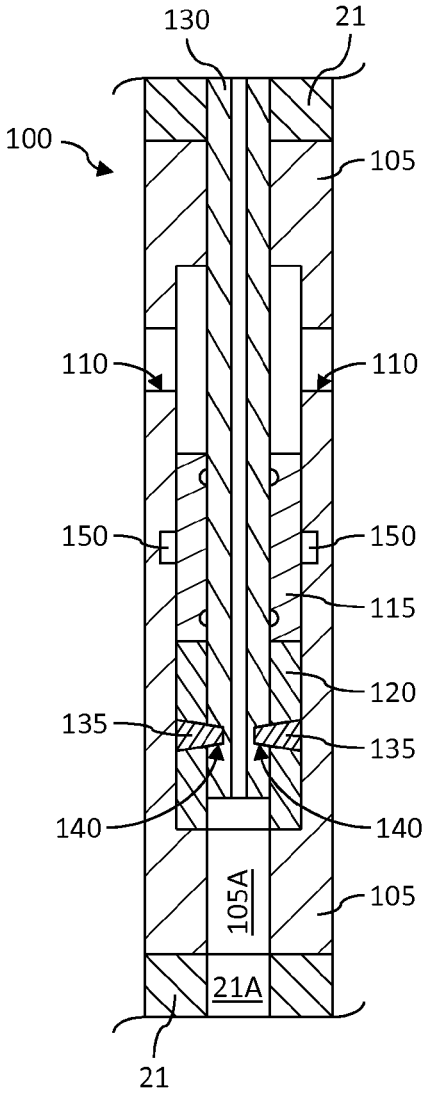
FIG. 3 is a schematic view of a portion of apparatus according to one or more aspects of the present disclosure.

FIG. 3 is a schematic view of the apparatus shown in FIG. 2. However, the wellbore 20, cement 32 and formation 50 are not shown in FIG. 3, although merely for the sake of clarity. Nonetheless, those skilled in the art will readily recognize that FIG. 3 depicts the same apparatus as is shown in FIG. 2 and in the same configuration as that shown in FIG. 2, with the exception that the shifting tool 130 has been run into the wellbore 20 to a depth sufficient for the features 135 of the STIM 120 and the features 140 of the shifting tool 130 to engage with one another. That is, the shifting tool 130 is axially translated in a downhole direction such that the shifting tool 130 passes entirely through the internal passage 115A of the moveable member 115 and into the internal passage 120A of the STIM 120, such that the features 140 of the shifting tool 130 and the features 135 of the STIM 120 become engaged. Alternatively, merely an end (or end portion) 130B of the shifting tool 130, rather than the entire shifting tool 130, may be axially translated through the internal passage 115A of the moveable member 115 and into the internal passage 120A of the STIM 120, perhaps even a short distance past the features 135 of the STIM 120 depending on how close the features 140 are to the end 130B of the shifting tool 130. In such configurations, for example, the shifting tool 130 may be conveyed in the wellbore 20 by one or more mechanical members, wirelines, slicklines, drilling tubulars, casing tubulars, coiled tubing and/or combinations thereof, among others. In any case, the downhole direction in which the shifting tool 130 is initially translated relative to the valve 100 is a direction towards the end or bottom of the wellbore 20, along a central axis of the wellbore 20.

Additionally, the valve 100 shown in FIG. 3 may be one of a plurality of valves coupled to the casing 21. For example, in an embodiment in which the valve 100 shown in FIG. 3 is the lowermost one of a plurality of valves, the shifting tool 130 may pass entirely through each of the other valves before arriving at the valve 100. The plurality of valves may also be substantially similar to the valve 100 shown in FIG. 3, although other types of valves may also or alternatively be utilized.

Figure 4:
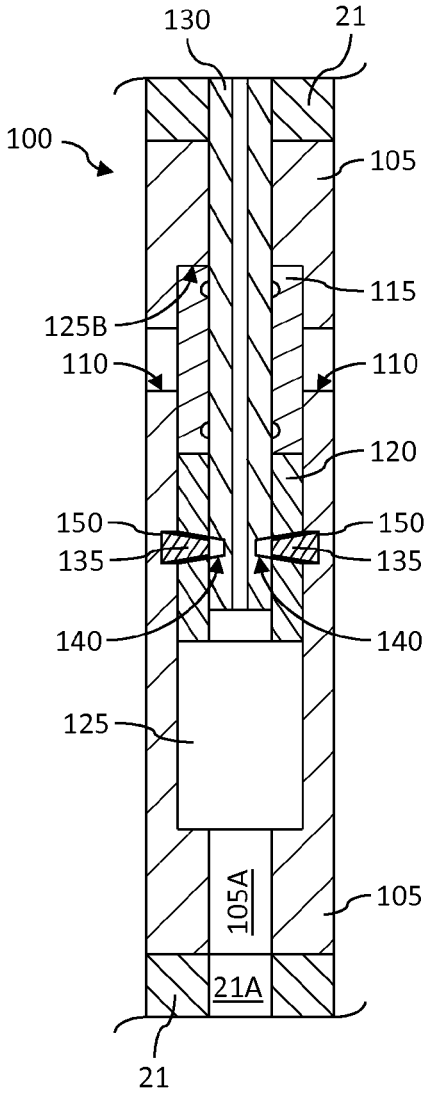
FIG. 4 is a schematic view of a portion of apparatus according to one or more aspects of the present disclosure.

FIG. 4 is a schematic view of the valve 100 shown in FIG. 3 after the shifting tool 130 has been axially translated in a second direction substantially opposite the direction of travel embodied in FIG. 3. That is, FIG. 3 depicts the result of the shifting tool 130 being axially translated in a downhole direction, whereas FIG. 4 depicts the result of the shifting tool 130 subsequently being axially translated in an uphole direction. The uphole direction, which may be substantially opposite to the downhole direction, is a direction away from the bottom end of the wellbore 20, but still along the central axis of the wellbore 20.

Nonetheless, the axial translation of the shifting tool 130 depicted by FIG. 4 is continued until the features 135 of the STIM 120 disengage from the shifting tool 130 and engage with the features 150 of the housing 105. Such disengagement (from the shifting tool 130) and engagement (to the housing 105) of the STIM 120 may be substantially simultaneous. For example, as shown in the exemplary embodiment shown in FIG. 4, the features 135 of the STIM 120 may be discrete members slidingly or otherwise moveably coupled to the STIM 120 such that, as they axially translate with the STIM 120 sufficiently for the features 135 to align with the features 150 of the housing 105, the features 135 slide radially out of engagement with the features 140 of the shifting tool 130 and substantially simultaneously slide substantially radially into engagement with the features 150 of the housing 105. These "engaging members" 135 of the STIM 120 may be biased toward the position in which they are engaged with the features 150 of the housing 105, whether such biasing is achieved mechanically (e.g., one or more springs and/or other elastic components), magnetically, hydraulically, pneumatically, chemically and/or otherwise.

After the features 135 of the STIM 120 disengage from the features 140 of the shifting tool 130, the shifting tool 130 is further translated in the second direction of travel (e.g., uphole or otherwise) away from the bottom of the wellbore 20. For example, the shifting tool 130 may be completely removed from the wellbore 20, or the above method may be repeated for additional valves coupled to the casing 21 above the first valve 100. That is, at each valve subsequently encountered by the shifting tool 130 (or the end 130B of the shifting tool) as the shifting tool 130 is axially translated away from the bottom of the wellbore 20, the features 140 of the shifting tool 130 may initially engage the features 135 of the STIM 120. Further axial translation of the shifting tool 130 uphole while engaged with the STIM 120 operates to axially translate the STIM 120 uphole. This further axial translation of the shifting tool 130 while engaged with the STIM 120 is continued, thereby continuing the axial translation of the STIM 120 until the features 135 of the STIM disengage from the features 140 of the shifting tool 130 and engage with the features 150 of the housing 105. The shifting tool 130 may then be further translated away from the bottom of the wellbore 20 to repeat the method with the next encountered valve, or to remove the shifting tool 130 from the wellbore 20.

The translation of the STIM 120 that results in the configuration depicted in FIG. 4 also operates to axially translate the moveable member 115 within the housing 105 of the valve 100. For example, as in the example shown in FIG. 4, the translation of the moveable member 115 may result in the moveable member 115 being positioned adjacent the ports 110 of the valve 100. Thus, the shifting tool 130 may be utilized according to one or more aspects of the present disclosure to axially translate the STIM 120, which also causes the axial translation of the moveable member 115 sufficiently to close the ports 110. Such translation of the moveable member 115 may be limited in a manner preventing the moveable member 115 to be translated past the ports 110. For example, the housing 105 and/or another component of the valve 100 may comprise one or more mechanical stops that, upon being contacted by the moveable member 115, prevent the moveable member 115 from further translation within the housing 105. Alternatively, as shown in FIG. 4, the end 125B of the internal cavity 125 may be positioned relative to the ports 110 such that when the moveable member 115 contacts the end 125B of the cavity 125, the moveable member 115 is positioned adjacent the ports 110, thus closing the ports 110 and thereby preventing any further fluid communication therethrough.

Moreover, because the STIM 120 is engaged with the housing 105 via interaction of their features 135 and 150, respectively, further axial translation of the STIM 120 relative to the housing 105 is prevented. Consequently, further axial translation of the moveable member relative to the housing 105 is also prevented because the moveable member is trapped between the STIM 120 and the end 125B of the internal cavity 125. In some embodiments within the scope of the present disclosure, such trapping of the moveable member 115 between the STIM 120 and the end 125B of the internal cavity 125 may permanently close the ports 110, thus isolating the internal cavity 125 from fluid that may otherwise be flowing into the cavity 125 from the formation 50 and/or the wellbore 20.

Although not shown in the figures, the valve 100 may comprise additional components. For example, the valve 100 may comprise seals between the outer surface of the moveable member 115 and the surface of the internal cavity 125 of the housing 105, such as may ensure the prevention of fluid flow into (or out of) the ports 110, when the moveable member 115 is in the position shown in FIG. 4. Similar seals may also be disposed between the outer surface of the STIM 120 and the surface of the internal cavity 125. These are merely examples of the seals and/or other components of the valve 100 which are not shown in the figures but that a person of skill in the art would readily recognize as being within the scope of the present disclosure.

The housing 105, moveable member 115, STIM 120, shifting tool 130 and any components or members thereof may be manufactured from a variety of different materials, such as carbon steel, stainless steel and/or others. One or more surfaces of the various components of the valve 100 may also be treated in some manner to reduce friction between surfaces intended to slide against one another. For example, the exterior surfaces 135 of the STIM 120 may comprise a XYLAN and/or other friction-reducing material, which may be applied via deposition, sputtering and/or other manufacturing methods.

The above method for configuring the valve 100 via axial translation of the shifting tool 130 in a direction away from the bottom of the wellbore 20 (i.e., uphole) may also be adapted for embodiments in which the valve 100 may be configured via axial translation of the shifting tool 130 in a direction towards the bottom of the wellbore 20 (i.e., downhole). Such embodiments, as well as other modifications and/or additions to and/or subtractions from the above-described method, are also within the scope of the present disclosure.

The moveable member 115 and the STIM 120 shown in FIGS. 2-4 are also depicted as discrete members. However, the moveable member 115 and the STIM 120 may be integrally formed as a single, discrete component of the valve 100. Alternatively, one or more discrete components in addition to the moveable member 115 and the STIM 120 may be positioned within the internal cavity 125, including additional discrete members disposed within the internal cavity in a manner permitting their axial translation (selectively or otherwise). Such additional members may be positioned between the STIM 120 and the end 125A of the internal cavity 125, between the moveable member 115 and the STIM 120, and/or between the moveable member 115 and the end 125B of the internal cavity 125.

Figure 5:
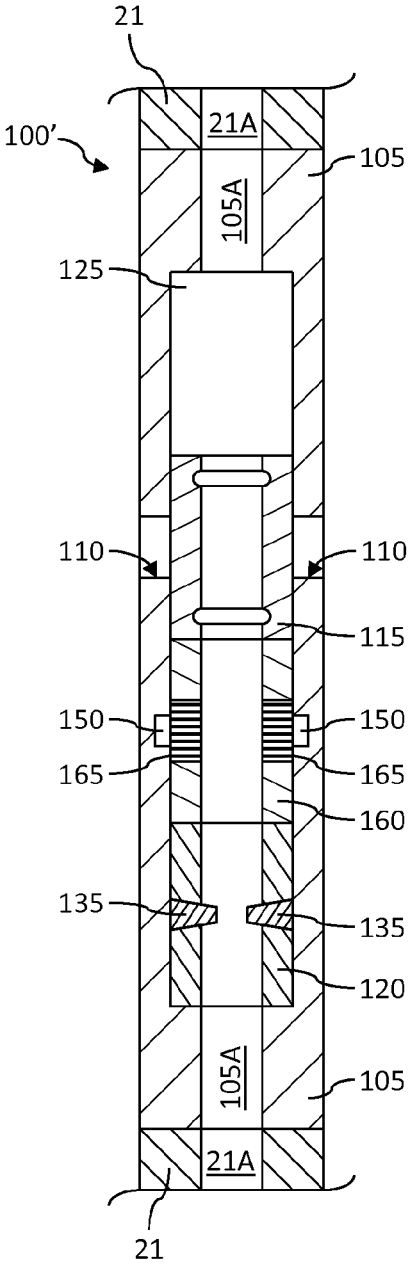
FIG. 5 is a schematic view of a portion of apparatus according to one or more aspects of the present disclosure.
Figure 6:
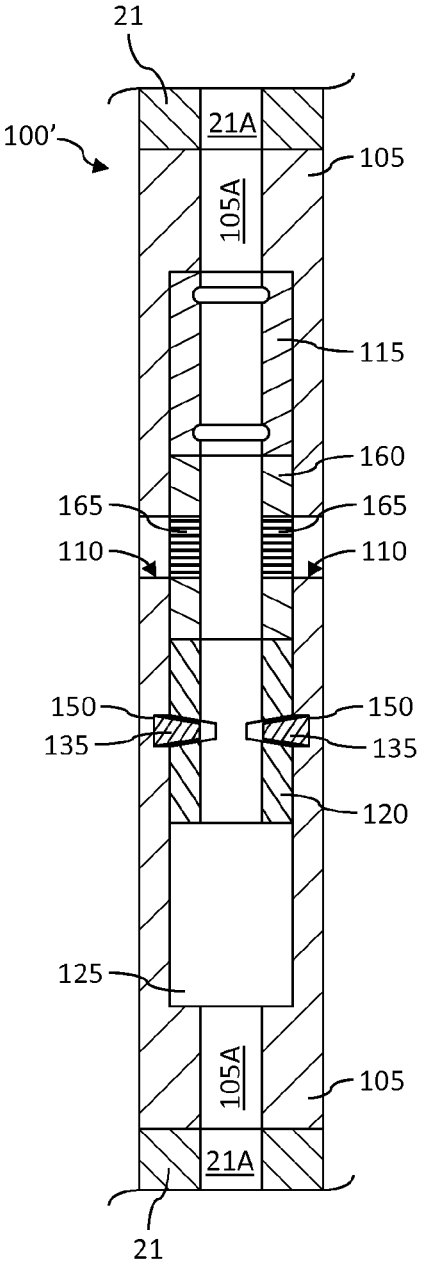
FIG. 6 is a schematic view of a portion of apparatus according to one or more aspects of the present disclosure.

For example, FIGS. 5 and 6 are schematic views of another embodiment of the valve 100 within the scope of the present disclosure, designated herein by reference numeral 100'. The valve 100' depicted in FIGS. 5 and 6 is substantially similar to the valve 100 shown in FIGS. 2-4, with the exception of the differences described below.

Like the valve 100 shown in FIGS. 2-4, the valve 100' shown in FIGS. 5 and 6 comprises the moveable member 115 and the STIM 120, each positioned within the internal cavity 125 of the housing 105. However, the valve 100' is depicted in FIGS. 5 and 6 as additionally comprising a sleeve 160 positioned in the internal cavity 125 between the moveable member 115 and the STIM 120. The sleeve 160 carries one or more filter elements 165. The one or more filter elements 165 may be or comprise one or more screens, sieves, filters and/or other members and/or components configured to prevent sand, debris and/or other contaminants from entering the internal cavity 125 when positioned adjacent the ports 110. For example, each of the one or more filter elements 165 may be or comprise a sintered metal filtration media and/or other types of screen materials, such as wire mesh, among others. However, the one or more filter elements 165 are limited to mechanically passive components. For example, the one or more filter elements 165 may comprise one or more rigid or otherwise inflexible filter components. Thus, the one or more filter elements 165 do not comprise burst seals or other flexible or intentionally destructible filtering or fluid control elements. Thus, at least with respect to some embodiments within the scope of the present disclosure, the valve 100' may be more robust than other valves which may comprise burst seals and/or other flexible filtering or fluid control elements, and may thus be more able to withstand the rigors of the downhole environment and operations therein.

The valve 100' is depicted in FIG. 5 in an example initial configuration for the above-described method of configuring the valve 100. As shown in FIG. 5, this initial configuration may comprise the moveable member 115 being positioned adjacent the ports 110 of the valve 100', thus preventing (at least substantially) fluid flow from the formation 50 and/or wellbore 20 into the internal cavity 125 of the housing 105. However, as described above with respect to the valve 100, initial configurations other than as shown in FIG. 5 are also within the scope of the present disclosure. For example, instead of being positioned immediately adjacent the sleeve 160 as shown in FIG. 5, the moveable member 115 may be positioned further away from the sleeve 160, perhaps as far away as the end 125B of the internal cavity 125. Similarly, the initial configuration of the valve 100' may include embodiments in which the sleeve 160 is not positioned immediately adjacent the STIM 120, but is instead positioned away from the STIM 120, including embodiments in which the sleeve 160 is immediately adjacent the moveable member 115 and embodiments in which the sleeve 160 is not immediately adjacent the moveable member 115.

FIG. 6 depicts the configuration of the valve 100' after the shifting tool 130 (not shown) has been utilized to axially translate the STIM 120 and, thus, the sleeve 160 and the moveable member 115 within the internal cavity 125 of the housing 105. An example method for performing such an operation may be substantially similar to the method described above with respect to FIGS. 2-4 for configuring the valve 100. For example, the shifting tool 130 is run into the wellbore 20 in a manner similar to that described above with reference to FIGS. 2-4. Such axial translation of the shifting tool 130 in the downhole direction is continued until the features 140 of the shifting tool 130 and the features 135 of the STIM 120 become engaged. Such axial translation of the shifting tool 130 includes axial translation of the shifting tool 130 (or its end 130B) through the moveable member 115 as described above, but also includes axial translation of the shifting tool 130 (or its end 130B) through the sleeve 160 before further translating into the STIM 120. Thereafter, the shifting tool 130 is axially translated in an uphole direction until the features 135 of the STIM 120 disengage the shifting tool 130 and subsequently, if not substantially simultaneously, engage with the features 150 of the housing 105.

Such translation also operates to axially translate the moveable member 115 away from the ports 110 of the valve 100', thus permitting fluid to flow from the formation 50 and/or the wellbore 20 into the internal cavity 125 through the ports 110. Moreover, the translation also operates to axially translate the sleeve 160 sufficiently to align the filter elements 165 with the ports 110 of the valve 100', such that the fluid flow now permitted through the ports 110 may be filtered by the filter elements 165 prior to entering the internal cavity 125.

As with the above-described method for configuring the valve 100 shown in FIGS. 2-4, the shifting tool 130 may then be further translated uphole, whether to configure additional instances of the valve 100' or to remove the shifting tool 130 from the wellbore 20. In embodiments in which the shifting tool 130 is utilized to configure multiple valves during one trip into the wellbore 20, the multiple valves may comprise one or more instances of the valve 100 shown in FIGS. 2-4, one or more instances of the valve 100' shown in FIGS. 5 and 6, and/or one or more other valves within the scope of the present disclosure.

Moreover, the filtering aspects of the valve 100' shown in FIGS. 5 and 6 may similarly be obtained by the valve 100 shown in FIGS. 2-4. In such embodiments, the moveable member 115 may comprise one or more filter elements 165 similar to those carried by the sleeve 160 shown in FIGS. 5 and 6.

Additionally, the valve 100 shown in FIGS. 2-4 and/or the valve 100' shown in FIGS. 5 and 6 may comprise only a single axially translatable component within the internal cavity 125. For example, in such embodiments where filtering is desired, the single axially translatable component may comprise one or more filter elements 165 similar to those carried by the sleeve 160 shown in FIGS. 5 and 6. Such single axially translatable components, whether comprising filter elements or not, may further comprise one or more features and/or other aspects of one or more of the moveable member 115, the STIM 120 and/or the sleeve 160.

Figure 7:
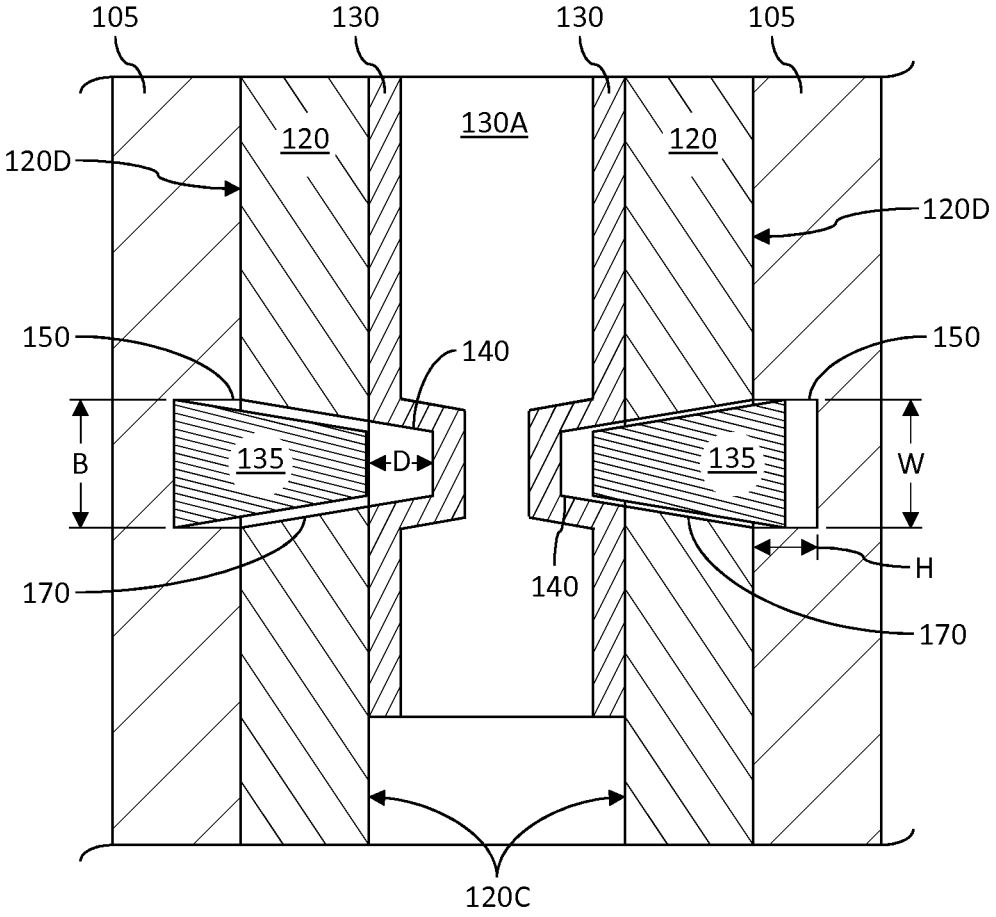
FIG. 7 is a schematic view of a portion of apparatus according to one or more aspects of the present disclosure.

FIG. 7 is an enlarged schematic view of a portion of the valve 100 shown in FIGS. 2-4, which may be substantially similar or identical to a corresponding portion of the valve 100' shown in FIGS. 5 and 6. The portion of the valve 100 shown in FIG. 7 includes portions of the housing 105, the STIM 120 and the shifting tool 130. FIG. 7 more clearly depicts the different positions of the features 135 of the STIM 120, and how the features 135 engage with the features 140 of the shifting tool 130.

That is, the features 135 are configured to radially translate between a first position and a second position. In the first position, the features 135 are engaged with the shifting tool 130 but not with the housing 105. In the second position, the features 135 are engaged with the housing 105 but not the shifting tool 130. In FIG. 7, the feature 135 on the left-hand side of the page is in the second position, where it is engaged with the housing 105 (e.g., with the feature 150 of the housing 105). The feature 135 on the right-hand side of the page is depicted as being between the first and second positions, although merely to illustrate how the feature 135 moves from the first position, where it is engaged with the shifting tool 130, to the second position, where it is engaged with the housing 105. In actual operation, the features 135 won't intentionally rest between the first and second positions in the manner depicted for the feature 135 on the right-hand side of the page in FIG. 7.

Thus, in embodiments in which the features 135 of the STIM 120 are discrete members (as well as other embodiments within the scope of the present disclosure), the members 135 may each be engaging members having first and second positions. When in the first position, as shown in FIGS. 2, 3 and 5, the members 135 may protrude from the inner profile 120C of the STIM 120 but may not protrude from the outer profile 120D of the STIM 120, and may even be recessed within the outer profile 120D in some embodiments. Accordingly, the members 135 protruding from the inner profile 120C of the STIM 120 may be engaged by the features 140 of the shifting tool 130, while the outer profile 120D of the STIM 120 remains substantially cylindrical or otherwise not interrupted by protruding portions of the members 135. That is, when in the first position, the members 135 may not protrude from the outer profile 120D of the STIM 120, and may even be recessed within the outer profile 120D in some embodiments. When in the second position, as shown in FIGS. 4 and 6 and the left-hand side of FIG. 7, the members 135 may protrude from the outer profile 120D of the STIM 120 but may not protrude from the inner profile 120C of the STIM 120, and may even be recessed within the inner profile 120C in some embodiments. Accordingly, the members 135 protruding from the outer profile 120D of the STIM 120 may be engaged by the features 150 of the housing 105, while the inner profile 120C of the STIM 120 remains substantially cylindrical or otherwise shaped to allow sliding of the shifting tool 130 relative to the STIM 120, because the members 135 are no longer engaged with the features 140 of the shifting tool 130.

In the example shown in FIG. 7, the features 135 of the STIM 120 may have a substantially trapezoidal cross-sectional shape. Similarly, the features 140 of the shifting tool 130 may also have a substantially trapezoidal cross-sectional shape, which may substantially correspond to the trapezoidal cross-sectional shape of the features 135 of the STIM 120. For example, the trapezoidal cross-sectional shape of the features 140 of the shifting tool 130 may form recesses configured to receive corresponding ones of the trapezoidal shaped features 135 of the STIM 120. Recesses 170 of the STIM 120, which carry the features 135, may similarly have a substantially trapezoidal cross-sectional shape, which may also substantially correspond to the trapezoidal cross-sectional shape of the features 135 of the STIM 120 and the features 140 of the shifting tool 130. Thus, in the example embodiment shown in FIG. 7, the recesses 170 of the STIM 120 and the features 140 of the shifting tool 130 may collectively form recesses which cooperate to receive the trapezoidal shaped features 135 of the STIM 120 when the STIM 120 and the shifting tool 130 are engaged.

As described above, the features 135 of the STIM 120 may be discrete members slidingly coupled to the STIM 120 in corresponding ones of the recesses 170. Such discrete members may be biased radially outward (via one or more springs and/or other means, not shown) such that they are urged radially outward and, ultimately, into the features 150 of the housing 105. The features 150 may have a substantially rectangular cross-sectional shape having a height H substantially equal to or greater than the depth D of the recessed features 140 of the shifting tool 130. The width W of the substantially rectangular cross-sectional shape of the features 150 may be substantially equal to or greater than the base B of the trapezoidal cross-sectional shape of the features 135 of the STIM 120, and may thus be able to receive the base B of the features 135.

Figure 8:
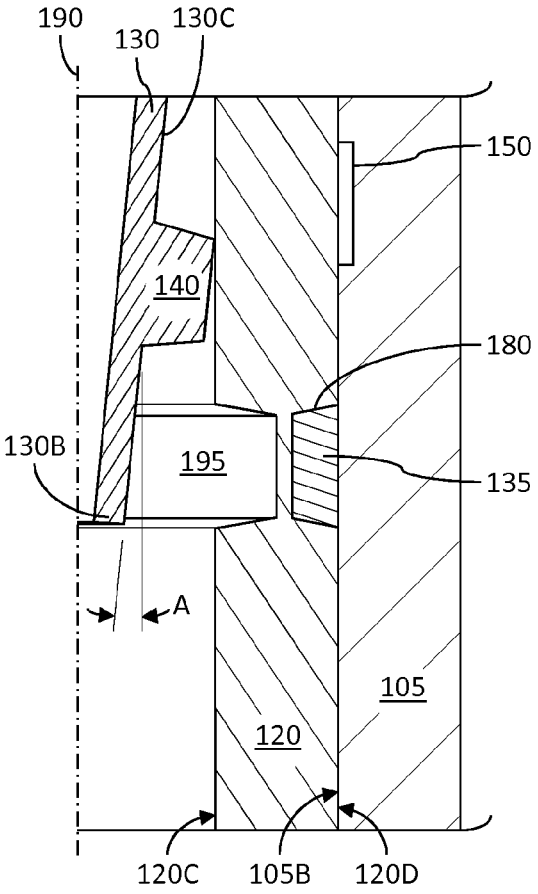
FIG. 8 is a schematic view of a portion of apparatus according to one or more aspects of the present disclosure.
Figure 9:
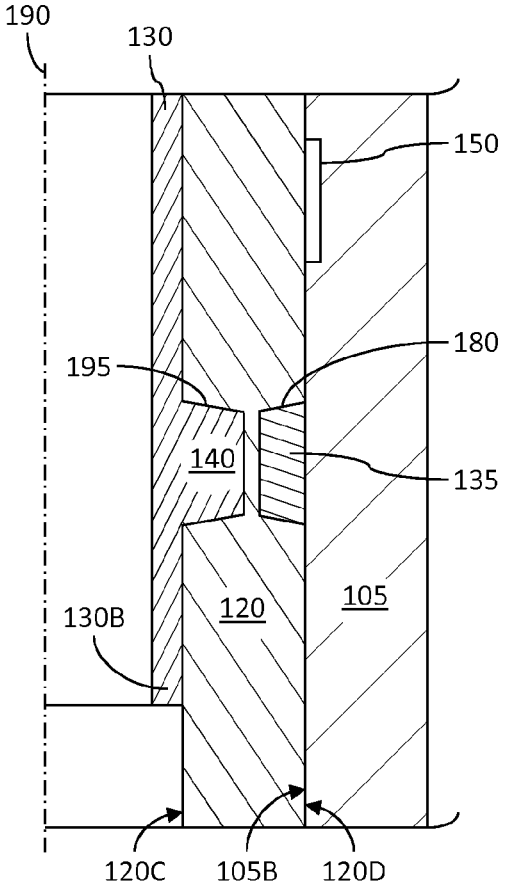
FIG. 9 is a schematic view of a portion of apparatus according to one or more aspects of the present disclosure.

However, the are many configurations possible for the features 135 of the STIM 120, the features 140 of the shifting tool 130, and the features 150 of the housing 105, other than as shown in FIGS. 2-7. For example, FIG. 8 is a schematic view of another embodiment of the valve 100 shown in FIGS. 2-4 and/or the valve 100' shown in FIGS. 5-7. In FIG. 8 (as well as FIGS. 9-11), only half of the depicted apparatus is shown, as if the apparatus is substantially symmetric across or around the axis or centerline 190 of the apparatus. However, such approach in the illustration of FIG. 8 (as well as FIGS. 9-11) is merely for the sake of clarity, and is not intended to mandate that any one or more embodiments within the scope of the present disclosure is necessarily symmetric with respect to a central axis or centerline. Nonetheless, embodiments exhibiting such symmetry are also within the scope of the present disclosure.

In the example shown in FIG. 8, the features 135 of the STIM 120 do not protrude from the internal profile 120C of the STIM 120, but are instead captured in corresponding recesses 180 in the outer profile 120D of the STIM 120 via the inner surface 105B of the housing 105. The features 140 of the shifting tool 130 are not recessed into the outer surface 130C of the shifting tool 130, as shown in FIGS. 2-7, but are instead convex or otherwise protrude from the outer surface 130C of the shifting tool 130.

The embodiment shown in FIG. 8 also more clearly demonstrates (relative to FIGS. 2-7) that at least a portion at or near the end 130B of the shifting tool 130 may be flexible or otherwise configured to deflect radially inward as the end 130B translates downhole until the features 140 of the shifting tool 130 can engage with the features 135 of the STIM 120. For example, the end 130B of the shifting tool 130 may comprise a plurality of substantially elastic fingers (one of which is shown in FIGS. 8-11) that are each able to temporarily deform inwards to allow the features 140 of the shifting tool 130 to engage with the features 135 of the STIM 120. As shown in FIG. 8, such deformable members may deflect inwards by at least an angle A, which may range between about 3 degrees and about 7 degrees, although other values for the angle A are also within the scope of the present disclosure. Moreover, configurations other than flexible members are also possible, such as where the shifting tool 130 comprises and/or utilizes one or more collets and/or expandable or adjustable rings, among myriad other alternatives within the scope of the present disclosure.

The STIM 120 ma also comprise recesses or other otherwise concave features 195 configured to receive the convex or otherwise protruding features 140 of the shifting tool 130. That is, sufficient axial translation of the shifting tool 130 permits the protruding features 140 of the shifting tool 130 to engage with the recessed features 195 of the STIM 120.

Figure 10:
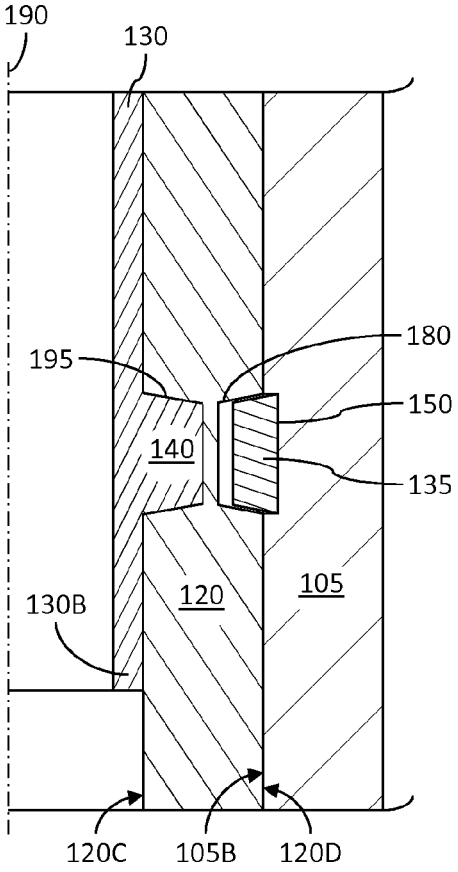
FIG. 10 is a schematic view of a portion of apparatus according to one or more aspects of the present disclosure.
Figure 11:
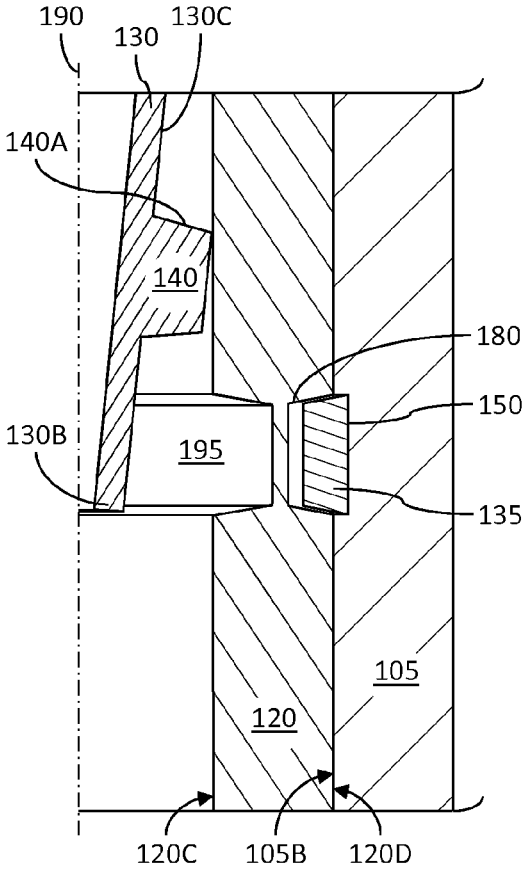
FIG. 11 is a schematic view of a portion of apparatus according to one or more aspects of the present disclosure.

Thereafter, the shifting tool 130 may be axially translated uphole, which also axially translates the STIM 120 uphole as a result of the engagement between the convex features 140 of the shifting tool 130 and the concave features 195 of the STIM 120. Such axial translation may be continued until, as shown in FIG. 10, the features 135 of the STIM 120 align with and are urged into the recessed or otherwise concave features 150 of the housing 105. Further axial translation will, as shown in FIG. 11, dislodge the features 140 of the shifting tool 130 from the features 195 of the STIM 120. That is, because the features 135 of the STIM 120 are now engaged with the features 150 of the housing 105, thus preventing axial translation of the STIM 120 relative to the housing 105, the continued uphole translation of the shifting tool 130 causes the disengagement of the features 140 from the features 195. The features 140 of the shifting tool 130 may have one or more sloped surfaces 140A or otherwise be configured to encourage the axial translation of the shifting tool 130 to be converted into radially inward deflection of the features 140 of the shifting tool 130.

Figure 12:
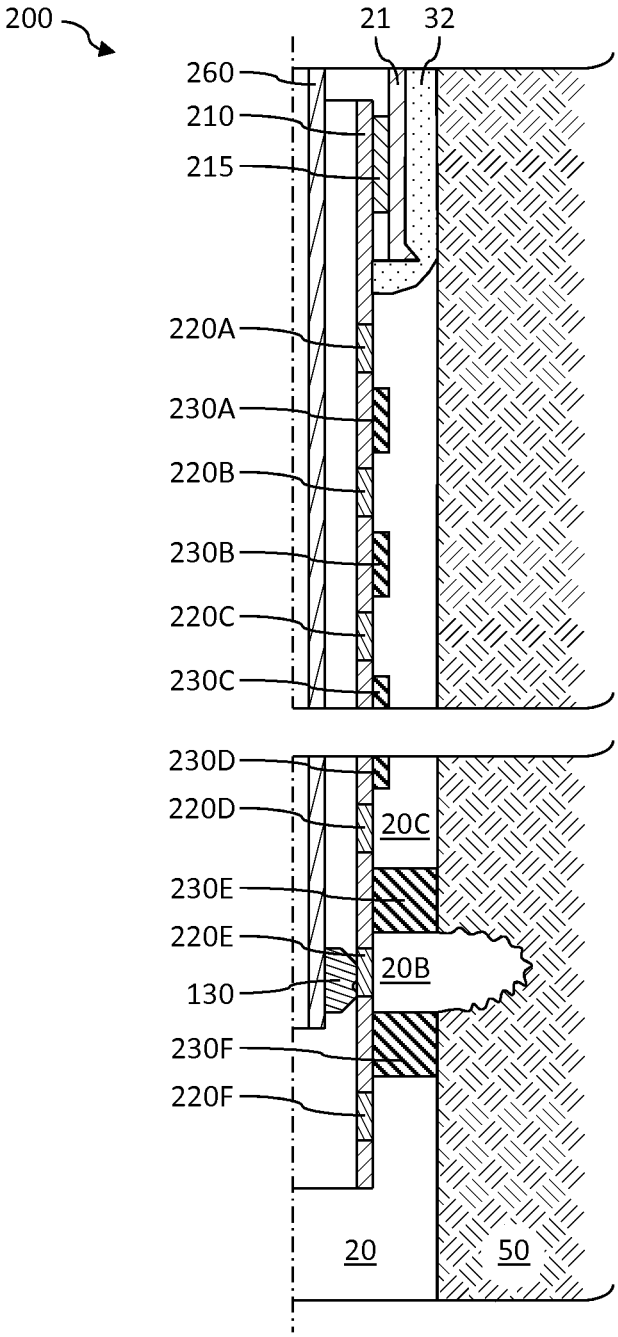
FIG. 12 is a schematic view of at least a portion of apparatus according to one or more aspects of the present disclosure.

As described above, one or more aspects of the present disclosure are applicable or readily adaptable to a variety of implementations in which a plurality of valves are deployed in a wellbore. One such example is depicted in FIG. 12, which is a schematic view of a likely completion 200 installed in the wellbore 20 during a transition from a non-production operational mode to a production operational mode, during which natural resources (e.g., gas, gas condensate, oil and/or combinations thereof) are produced from the completed wellbore 20. One or more aspects of the implementation depicted in FIG. 12 may be substantially similar or identical to one or more aspects of the implementation depicted in FIG. 1. In fact, the two implementations may be substantially the same but for the differences explicitly described herein, although any aspect described with reference to FIG. 12 may be applicable or readily adaptable to the implementation depicted in FIG. 1. For example, the orientation of the wellbore 20 is not limited within the scope of the present disclosure, such that the aspects described with respect to the vertical wellbore 20 shown in FIG. 12 may be applicable or readily adaptable to the non-vertical wellbore 20 shown in FIG. 1. Moreover, in FIG. 12, only half of the depicted apparatus is shown, as if the apparatus is substantially symmetric with respect to the axis or centerline 190 of the apparatus. However, such approach in the illustration of FIG. 12 is merely for the sake of clarity, and is not intended to mandate that any one or more embodiments within the scope of the present disclosure is necessarily symmetric with respect to a central axis or centerline. Nonetheless, embodiments exhibiting such symmetry are also within the scope of the present disclosure.

The wellbore 20 depicted in FIG. 12 is open hole at its lower end (e.g., casing has not yet been installed). The casing 21 is cemented with cement 32. A running string (not shown) may be utilized to carry in a work string 210 which may be secured to the casing 21 with a hanger/packer 215. As with embodiments described above, the work string 210 may comprise any number of valves 220A-F, each of which may be substantially similar to the valve 100 shown in FIGS. 2-4 and/or the valve 100' shown in FIGS. 5 and 6. One or more of the valves 220A-F may also or alternatively have one or more aspects similar to those described with respect to FIGS. 7-11. For example, each of the valves 220A-F may comprise or otherwise be associated with one or more ports, each of which may be substantially similar or identical to the ports 110 described above. However, the valves 220A-F need not all be identical. For example, some of the valves 220A-F may be substantially identical to the valve 100 shown in FIGS. 2-4, while other ones of the valves 220A-F may be substantially identical to the valve 100' shown in FIGS. 5 and 6. Thus, some of the valves 220A-F may be two-position valves having only two positions selected from a fracture position, a closed-port position and a filtering position, as described above. Similarly, some of the valves 220A-F may be three-position valves having closed-port, fracture and filtering positions, as described above.

The completion depicted in FIG. 12 may further comprise one or more external packers 230A-F. The packers 230A-F may be any of a variety of conventional or future-developed packer styles, perhaps including those that may be set by swelling or expansion. For example, two of the packers 230E and 230F are shown in the set position after swelling or expansion, thereby isolating a portion 20B of the wellbore 20. At this point in the method, the ports of the valves 220A-F may be closed.

FIG. 12 also depicts a shifting tool 130 which may be substantially similar or identical to the shifting tool 130 shown in FIGS. 2-11. The shifting tool 130 may be run in via any means of conveyance, generally designated in FIG. 12 by reference numeral 260. As described above, the shifting tool 130 may be run into the wellbore 20 to configure the valves 220A-F, such as to axially translate internal sliding components of the valves 220A-F such that the valves 220A-F can be configured in the desired fracture, filtering or closed position.

FIG. 12 also depicts the wellbore portion 20B having been fully fractured, such that the shifting tool 130 and the work string 210 may be repositioned and ready to configure the next valve 220D in preparation for fracturing of the next wellbore portion 20C. Thereafter, the shifting tool 130 may again be shifted uphole into position to configure the next valve 220C. As described above, this process may then be repeated for the remaining valves 220A and 220B to complete the transition from the non-production operational mode to a production operational mode. Of course, such transition may comprise additional processes not explicitly described herein, such as setting a production string (not shown) into position within the wellbore 20.

To reduce trips in the wellbore 20, the conveyance means that delivers the casing 21 may also comprise the shifting tool 130, thus eliminating any need to run a separate conveyance means 260 with the shifting tool 130 on its lower end. In fact, the same string that delivers the casing 21 may also be equipped with the shifting tool 130 and an additional external packer (not shown), such as to serve as the production string after the valves 220A-F have been configured for the production operational mode (e.g., ones or all of the valves 220A-F being configured in the filtering position).

Utilizing one or more aspects introduced in the present disclosure may eliminate the need to run separate screens and a crossover tool. The fracturing operation performed in each well zone (e.g., wellbore portion 20B or 20C) may thus be performed at each one of the valves 220A-F as each are sequentially encountered by the shifting tool 130. Thus, after completing all of the fracturing operations at each well zone, the well can go right to production through the filter elements in the valves 220A-F when aligned with their respective ports. Eliminating use of a crossover tool may reduce the risks of its failure from erosion or from getting stuck, as well as the risks accompanying conventional fracturing followed by gravel packing. The elimination of gravel packing may also remove risks of bridging during gravel packing or complex structures such as bypass tubes in the annulus to get around sand bridges that form during gravel packing. Countless hours of rig time may be saved, as well as equipment charges to the well operator.

In view of the entirety of the present disclosure, including the figures, those having ordinary skill in the art should readily recognize that the present disclosure introduces a method, comprising: moving a shifting tool in a first direction through a moveable member positioned in a casing of a wellbore, including moving the shifting tool into a shifting tool interface member (STIM) adjacent the moveable member; engaging the shifting tool and the STIM; and moving the shifting tool in a second direction substantially opposite the first direction, thereby moving the STIM and the moveable member in the second direction, until the STIM substantially simultaneously: engages the casing; and disengages the shifting tool. The casing may comprise a tubular lining, and at least a portion of the tubular lining may be cemented to the wellbore. The casing may comprise a housing, the moveable member and the STIM may be slidingly disposed within the housing, and the housing may be coupled to a tubular lining having at least a portion cemented to the wellbore.

Moving the shifting tool in the first direction through the moveable member and the STIM may comprise moving at least an end portion of the shifting tool past the moveable member and an engaging member of the STIM. Engaging the shifting tool and the STIM may comprise moving the shifting tool in the second direction until the shifting tool and the STIM engage.

The first direction may be a downhole direction towards the bottom of the wellbore, and the second direction may be an uphole direction away from the bottom of the wellbore. The first direction may be an uphole direction away from the bottom of the wellbore, and the second direction may be a downhole direction towards the bottom of the wellbore.

One of the shifting tool and the STIM may comprise a protruding feature and the other one of the shifting tool and the STIM may comprise a recessed feature, and engaging the shifting tool and the STIM may comprise receipt of the protruding feature within the recessed feature. The shifting tool may comprise a concave feature and the STIM may comprise a convex feature, and engaging the shifting tool and the STIM may comprise receipt of the convex feature of the STIM within the concave feature of the shifting tool. The STIM may comprise a protruding feature and the casing may comprise a recessed feature, and engagement of the STIM and the casing may comprise receipt of the protruding feature of the STIM within the recessed feature of the casing. The casing may comprise a concave feature and the STIM may comprise a convex feature, and engagement of the STIM and the casing may comprise receipt of the convex feature of the STIM within the concave feature of the casing.

The STIM may comprise an engaging member moveable between a first position and a second position, the engaging member may protrude from an inner profile of the STIM when in the first position, and the engaging member may protrude from an outer profile of the STIM when in the second position. The step of moving the shifting tool in the second direction may include moving the shifting tool, and thereby the STIM and the moveable member, in the second direction until the engaging member moves radially out of engagement with the shifting tool and into engagement with a recessed feature of an internal profile of the casing. The engaging member may not protrude from the outer profile of the STIM when in the first position, and may protrude from the inner profile of the STIM when in the second position. The engagement of the shifting tool and the STIM may comprise engagement between the shifting tool and the engaging member in the first position. The engagement of the casing and the STIM may comprise engagement between the casing and the engaging member in the second position. The STIM substantially simultaneously engaging the casing and disengaging the shifting tool may comprise motion of the engaging member from the first position to the second position, whereby the shifting tool may disengage the engaging member and, substantially simultaneously, the casing may engage the engaging member.

The casing, the moveable member and the STIM may collectively form one of a plurality of substantially similar valves that may form part of a completion system deployed in a multi-zone area of the wellbore, and the multi-zone area may comprise a plurality of well zones that each may be proximate a corresponding one or more of the plurality of valves.

The moveable member may be substantially rigid. The moveable member may be substantially not flexible. The moveable member may not comprise a burst seal. The moveable member may be moveable in that the entire moveable member may translate axially relative to the casing.

The method may further comprise, after the shifting tool and the STIM disengage, moving the shifting tool further in the uphole direction past the STIM and the moveable member.

The STIM may be adjacent a first end of the moveable member, the step of moving the shifting tool in the first direction may include moving the shifting tool in the first direction through a sleeve adjacent a second end of the moveable member, and the step of moving the shifting tool in the second direction, thereby moving the STIM and the moveable member in the second direction, may also move the sleeve in the second direction. Moreover, the first direction may be downhole towards the bottom of the wellbore, the second direction may be uphole away from the bottom of the wellbore, the first end of the moveable member may be a downhole end, and the second end of the moveable member may be an uphole end. Moreover, the shifting tool and the sleeve may not be able to engage. Moreover, the sleeve and the filter may be integrally formed from a single member.

The moveable member may comprise a filter, the moveable member and the STIM may collectively form part of a valve connected to the casing, the valve may selectively establish a flow path between an internal passage of the casing and a well zone adjacent the valve, and the step of moving the shifting tool in the second direction, thereby moving the STIM and the moveable filter in the second direction, may include moving the filter of the moveable member into the flow path.

The shifting tool may comprise at least one flexible member, and moving the shifting tool in the first direction may include contacting at least one protruding feature of the STIM with the at least one flexible member of the shifting tool, such that moving the shifting tool further in the first direction after contacting the at least one protruding feature of the STIM with the at least one flexible member of the shifting tool may cause the at least one flexible member of the shifting tool to deflect radially inward. Engaging the shifting tool and the STIM may comprise moving the shifting tool even further in the first direction until the radially inward deflection of the at least one flexible member lessens as a result of engagement of the at least one flexible member of the shifting tool with the protruding feature of the STIM.

The present disclosure also introduces a method comprising: moving a shifting tool in a first direction relative to a plurality of valves that are each connected to a casing of a wellbore having a plurality of well zones, wherein each of the plurality of valves comprises: a port for receiving fluid flow from a corresponding one of the plurality of well zones; a filter moveable between a filtering position, for filtering the fluid flow from the corresponding one of the plurality of well zones through the port, and a non-filtering position; and a shifting tool interface member (STIM); and moving the shifting tool in a second direction substantially opposite to the first direction, such that at each one of the plurality of valves successively encountered by the shifting tool as it moves in the second direction: the STIM moves in the second direction as a result of engagement with the moving shifting tool; and the filter moves from the non-filtering position to the filtering position as a result of contact with the moving STIM.

In such method, moving the shifting tool in the first direction may comprise engaging and then disengaging the shifting tool with the STIM of each of the plurality of valves successively encountered by the shifting tool as the shifting tool moves in the first direction, and moving the shifting tool in the second direction may comprise: engaging the shifting tool with the STIM of each of the plurality of valves successively encountered by the shifting tool as the shifting tool moves in the second direction; moving the shifting tool in the second direction while the shifting tool is engaged with the STIM, thereby also moving the STIM engaged by the shifting tool in the second direction, thereby also moving the filter adjacent the STIM engaged by the shifting tool in the second direction from the non-filtering position to the filtering position; and disengaging the shifting tool from the STIM of the encountered one of the plurality of valves.

Each of the plurality of valves may comprise a sleeve moveable between: a closed-port position in which the sleeve interrupts the fluid flow from the corresponding one of the plurality of well zones through the port; and an open-port position in which the sleeve permits the fluid flow from the corresponding one of the plurality of valves through the port. Translating the shifting tool in the second direction may also move the sleeve at each successively encountered valve from its closed-port position to its open-port position. The sleeve may be maintained in its open-port position by the filter when the filter is in its filtering position. The shifting tool may be engageable with the STIM of each of the plurality of valves but may not be able to engage with the sleeve of any of the plurality of valves. Within each one of the plurality of valves, the sleeve and the filter may be integrally formed as a single discrete member.

The first direction may be a downhole direction towards the bottom of the wellbore, and the second direction may be an uphole direction away from the bottom of the wellbore. The first direction may be an uphole direction away from the bottom of the wellbore, and the second direction may be a downhole direction towards the bottom of the wellbore.

Engagement of the shifting tool and the STIM may comprise receipt of a convex feature of the STIM within a concave feature of the shifting tool.

At each successively encountered one of the plurality of valves, movement of the STIM sufficient to move the filter from the non-filtering position to the filtering position may result in disengagement of the STIM from the shifting tool and engagement of the STIM with a housing of the encountered one of the plurality of valves. The housing may be an integral portion of the casing. The housing may be a discrete member coupled to the casing. Disengagement of the STIM from the shifting tool and engagement of the STIM with the housing may occur substantially simultaneously. The STIM of each of the plurality of valves may comprise a protruding feature and the casing may comprise a recessed feature, and engagement of the encountered STIM and the casing may comprise receipt of the protruding feature of the STIM within the recessed feature of the casing.

The STIM of each of the plurality of valves may comprise an engaging member moveable between a first position and a second position, the engaging member may protrude from an inner profile of the STIM when in the first position, and the engaging member may protrude from an outer profile of the STIM when in the second position. Moving the shifting tool in the second direction may include moving the shifting tool, and thereby the STIM and the filter of each successively encountered one of the plurality of valves, in the second direction until the engaging member of the STIM of the encountered one of the plurality of valves moves radially out of engagement with the shifting tool and into engagement with a corresponding one of a plurality of recessed features of an internal profile of the casing. The engaging member of the STIM of each of the plurality of valves may not protrude from the outer profile of the corresponding STIM when in the first position, and the engaging member of the STIM of each of the plurality of valves may not protrude from the inner profile of the corresponding STIM when in the second position. Engagement of the shifting tool and the STIM of each successively encountered one of the plurality of valves may comprise engagement between the shifting tool and the engaging member of the STIM in the first position. Engagement of the casing and the STIM of each successively encountered one of the plurality of valves may comprise engagement between the casing and the engaging member of the STIM in the second position. The STIM of each successively encountered one of the plurality of valves substantially simultaneously engaging the casing and disengaging the shifting tool may comprise motion of the engaging member from the first position to the second position, whereby the shifting tool may disengage the engaging member and, substantially simultaneously, the casing may engage the engaging member.

The casing may be part of a completion system deployed in a multi-zone area of the wellbore, and the multi-zone area may comprise a plurality of well zones that are each proximate a corresponding one or more of the plurality of valves.

The filter of each of the plurality of valves may be substantially rigid. The filter of each of the plurality of valves may be substantially not flexible. The filter of each of the plurality of valves may not comprise a burst seal. The filter of each of the plurality of valves may be moveable in that the entire filter may translate axially relative to the casing.

The method may further comprise at each successively encountered one of the plurality of valves, after the shifting tool and the STIM disengage, moving the shifting tool further in the second direction past the STIM and the filter.

Each of the plurality of valves may comprise a sleeve. Moving the shifting tool in the first direction may comprise moving the shifting tool through ones of the plurality of valves, including through the sleeve, the filter and the STIM thereof. The step of moving the shifting tool in the second direction, thereby moving the STIM and the filter in the second direction, may also move the sleeve in the second direction. The shifting tool and the sleeve of each of the plurality of valves may not be able to engage. Within each of the plurality of valves, the sleeve and the filter may be integrally formed as a single discrete member.

The method may not comprise translating the shifting tool in the first direction after the shifting tool has started translating in the second direction until after the shifting tool moves the STIM and the filter of each of the plurality of valves.

The present disclosure also introduces an apparatus comprising: a valve connected to a wellbore casing proximate a well zone and comprising: a port for fluid communication along a flow path extending from the well zone into the casing through the port; a filter moveable between a filtering position and a non-filtering position, wherein the filter is in the flow path when in the filtering position but not when in the non-filtering position, and wherein the filter comprises a first internal passage through which a shifting tool passes in downhole and uphole directions without engaging the filter; and a shifting tool interface member (STIM) adjacent an end of the filter and having a second internal passage engageable with the shifting tool, wherein engagement between the shifting tool and the internal passage of the STIM permits uphole motion of the shifting tool to be translated into uphole motion of the STIM, and wherein sufficient uphole motion of the STIM moves the STIM into engagement with the casing and, substantially simultaneously, out of engagement with the shifting tool.

The valve may further comprise a sleeve moveable from a closed-port position to an open-port position, wherein uphole motion of the shifting tool, the STIM and the filter may translate to uphole motion of the sleeve from the closed-port position to the open-port position, wherein the flow path may be interrupted by the sleeve when the sleeve is in the closed-port position, and wherein the sleeve may comprise a third internal passage through which the shifting tool passes in downhole and uphole directions without engaging the sleeve. The filter may be disposed between the sleeve and the STIM. The shifting tool may be a first shifting tool, wherein the first shifting tool may pass through the third internal passage in the first and second directions without engaging the sleeve, and wherein the third internal passage may be detachably engageable with a second shifting tool to translate the sleeve within the valve without also translating the filter and the STIM. The filter and the STIM may not be able to engage the second shifting tool.

The downhole direction may be towards the bottom of the wellbore, and the uphole direction may be away from the bottom of the wellbore.

Uphole movement of the STIM sufficient to engage the casing may move the filter away from the non-filtering position and into the filtering position.

The valve may be one of a plurality of substantially similar valves each connected to the casing and each comprising an instance of the port, the filter and the STIM. Continued uphole movement of the shifting tool may encounter each successive one of the plurality of valves, thereby engaging the STIM of each successively encountered valve to translate the STIM uphole, thereby moving the filter of each successively encountered valve from the non-filtering position to the filtering position.

The STIM may comprise a protruding feature and the shifting tool may comprise a recessed feature, and engagement of the shifting tool and the STIM may comprise receipt of the protruding feature of the STIM within the recessed feature of the shifting tool. The shifting tool may comprise a concave feature and the STIM may comprise a convex feature, and engagement of the shifting tool and the STIM may comprise receipt of the convex feature of the STIM within the concave feature of the shifting tool. The STIM may comprise a protruding feature and the casing may comprise a recessed feature, and engagement of the STIM and the casing may comprise receipt of the protruding feature of the STIM within the recessed feature of the casing. The casing may comprise a concave feature and the STIM may comprise a convex feature, and engagement of the STIM and the casing may comprise receipt of the convex feature of the STIM within the concave feature of the casing.

The STIM may comprise an engaging member moveable between a first position and a second position, wherein the engaging member may protrude from an inner profile of the STIM when in the first position, and wherein the engaging member may protrude from an outer profile of the STIM when in the second position. The engaging member may be in the first position when the STIM is engaged with the shifting tool, and the engaging member may be in the second position when the STIM is engaged with the casing. The uphole motion of the STIM sufficient to move the STIM into engagement with the casing and out of engagement with the shifting tool may include uphole motion of the STIM sufficient for the engaging member to move radially out of engagement with the shifting tool and into engagement with the casing. The STIM and the casing may not be able to engage when the engaging member is in the first position, and the STIM and the shifting tool may not be able to engage when the engaging member is in the second position. The engaging member may not protrude from the outer profile of the STIM when in the first position, and the engaging member may not protrude from the inner profile of the STIM when in the second position. The engaging member may protrude from the inner profile of the STIM but not the outer profile of the STIM when in the first position, and the engaging member may protrude from the outer profile of the STIM but not the inner profile of the STIM when in the second position. The engaging member may be recessed within the outer profile of the STIM when in the first position, and the engaging member may be recessed within the inner profile of the STIM when in the second position. Engagement of the shifting tool and the STIM may comprise engagement between the shifting tool and the engaging member in the first position. Engagement of the casing and the STIM may comprise engagement between the casing and the engaging member in the second position. The STIM substantially simultaneously moving into engagement with the casing and out of engagement with shifting tool may comprise radial translation of the engaging member from the first position to the second position, whereby the shifting tool may disengage the engaging member and, substantially simultaneously, the casing may engage the engaging member.

The casing may be part of a completion system deployed in a multi-zone area of the wellbore, wherein the multi-zone area may comprise a plurality of well zones that may each be proximate a corresponding one or more of a plurality of valves associated with the casing, and wherein the plurality of valves may be substantially similar and may each comprise an instance of the filter and the STIM.

The filter may be substantially rigid. The filter may be substantially not flexible. The filter may not comprise a burst seal. The filter may be moveable in that the entire filter may translate axially relative to the casing.

The present disclosure also introduces a method comprising: transitioning from a non-production operational mode of a wellsite to a production operational mode, wherein the wellsite comprises a wellbore intersecting a plurality of well zones, wherein at least a portion of the wellbore comprises a casing, wherein a plurality of valves associated with the casing each comprise a moveable member and a shifting tool interface member (STIM) each positioned in the casing, and wherein transitioning from the non-production operational mode of the wellsite to the production operational mode comprises: (a) moving a shifting tool in a first direction through the moveable member and the STIM of each of the plurality of valves; (b) moving the shifting tool in a second direction substantially opposite the first direction until the shifting tool and the STIM of the then most proximate valve engage; (c) moving the shifting tool further in the second direction, thereby moving the engaged STIM and its associated moveable member in the second direction, until the engaged STIM substantially simultaneously: disengages the shifting tool; and engages the casing; and (d) repeating steps (b) and (c) at each successively encountered one of the plurality of valves as the shifting tool moves further in the second direction.

The first direction may be a downhole direction towards the bottom of the wellbore, and the second direction may be an uphole direction away from the bottom of the wellbore. The first direction may be an uphole direction away from the bottom of the wellbore, and the second direction may be a downhole direction towards the bottom of the wellbore.

The STIM of each of the plurality of valves may comprise a protruding feature and the shifting tool may comprise a recessed feature, and engagement of the shifting tool and the STIM of each successive one of the plurality of valves may comprise receipt of the protruding feature within the recessed feature. The shifting tool may comprise a concave feature and the STIM of each of the plurality of valves may comprise a convex feature, and engagement of the shifting tool and the STIM of each successive one of the plurality of valves may comprise receipt of the convex feature within the concave feature. The STIM of each of the plurality of valves may comprise a protruding feature and the casing may comprise a recessed feature, and engagement of the STIM of each successive one of the plurality of valves and the casing may comprise receipt of the protruding feature within the recessed feature. The casing may comprise a concave feature and the STIM of each of the plurality of valves may comprise a convex feature, and engagement of the STIM of each successive one of the plurality of valves and the casing may comprise receipt of the convex feature within the concave feature.

The STIM of each of the plurality of valves may comprise an engaging member moveable between a first position and a second position, wherein the engaging member may protrude from an inner profile of the STIM when in the first position, and wherein the engaging member may protrude from an outer profile of the STIM when in the second position. Step (c) may include moving the shifting tool, and thereby the STIM and the moveable member of the presently encountered one of the plurality of valves, in the second direction until the engaging member moves radially out of engagement with the shifting tool and into engagement with a recessed feature of an internal profile of the casing. The engaging member may not protrude from the outer profile of its associated STIM when in the first position, and the engaging member may not protrude from the inner profile of its associated STIM when in the second position. Engagement of the shifting tool and the STIM of each successively encountered one of the plurality of valves may comprise engagement between the shifting tool and the STIM's engaging member in the first position. Engagement of the casing and the STIM of each successively encountered one of the plurality of valves may comprise engagement between the casing and the STIM's engaging member in the second position.

For each successively encountered one of the plurality of valves, the STIM substantially simultaneously engaging the casing and disengaging the shifting tool may comprise motion of the engaging member from the first position to the second position, whereby the shifting tool may disengage the engaging member and, substantially simultaneously, the casing may engage the engaging member.

The casing may be part of a completion system deployed in the wellbore proximate the plurality of well zones, and the plurality of well zones may each be proximate a corresponding one or more of the plurality of valves.

The moveable member may be substantially rigid. The moveable member may be substantially not flexible. The moveable member may not comprise a burst seal. The moveable member may be moveable in that the entire moveable member may translate axially relative to its associated one of the plurality of valves.

Each of the plurality of valves may further comprise a sleeve. Within each of the plurality of valves, the moveable member may be positioned between the STIM and the sleeve. Step (a) may include moving the shifting tool in the first direction through the sleeve of each of the plurality of valves. Step (c) may also move, in the second direction, the sleeve of each successively encountered one of the plurality of valves. The shifting tool may not engage with the sleeve of any of the plurality of valves. Within each of the plurality of valves, the sleeve and the filter may be integrally formed from a single discrete member.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method, comprising:

moving a shifting tool in a first direction through a moveable member positioned in a casing of a wellbore, including moving the shifting tool into a shifting tool interface member (STIM) adjacent the moveable member;

engaging the shifting tool and the STIM;

moving the shifting tool in a second direction substantially opposite the first direction, thereby moving the STIM and the moveable member in the second direction, until the STIM substantially simultaneously:

engages the casing; and disengages the shifting tool;

wherein the STIM comprises an engaging member in a recess of the STIM and moveable between a first position and a second position, the engaging member does not protrude from the outer profile of the STIM when in the first position, and the engaging member protrudes from an outer profile of the STIM when in the second position; and wherein the step of moving the shifting tool in the second direction includes moving the shifting tool, and thereby the STIM and the moveable member, in the second direction until the engaging member moves into engagement with a recessed feature of an internal profile of the casing.

2. The method of claim 1 wherein engaging the shifting tool and the STIM comprises moving the shifting tool in the second direction until the shifting tool and the STIM engage.

3. The method of claim 1 wherein the first direction is a downhole direction towards the bottom of the wellbore, and wherein the second direction is an uphole direction away from the bottom of the wellbore.

4. The method of claim 1 wherein:

the engaging member protrudes from an inner profile of the STIM when in the first position; and the step of moving the shifting tool in the second direction includes moving the shifting tool, and thereby the STIM and the moveable member, in the second direction until the engaging member moves radially out of engagement with the shifting tool and into engagement with the recessed feature of the internal profile of the casing.

5. The method of claim 4 wherein:

engagement of the shifting tool and the STIM comprises engagement between the shifting tool and the engaging member in the first position; and engagement of the casing and the STIM comprises engagement between the casing and the engaging member in the second position.

6. The method of claim 4 wherein the STIM substantially simultaneously engaging the casing and disengaging the shifting tool comprises motion of the engaging member from the first position to the second position, whereby the shifting tool disengages the engaging member and, substantially simultaneously, the casing engages the engaging member.

7. The method of claim 1 wherein:

the STIM is adjacent a first end of the moveable member;

the step of moving the shifting tool in the first direction includes moving the shifting tool in the first direction through a sleeve adjacent a second end of the moveable member; and the step of moving the shifting tool in the second direction, thereby moving the STIM and the moveable member in the second direction, also moves the sleeve in the second direction.

8. The method of claim 1 wherein:

the moveable member comprises a filter;

the moveable member and the STIM collectively form part of a valve connected to the casing;

the valve selectively establishes a flow path between an internal passage of the casing and a well zone adjacent the valve; and the step of moving the shifting tool in the second direction, thereby moving the STIM and the moveable filter in the second direction, includes moving the filter of the moveable member into the flow path.

9. The method of claim 1 wherein the shifting tool comprises at least one flexible member, and wherein moving the shifting tool in the first direction includes contacting at least one protruding feature of the STIM with the at least one flexible member of the shifting tool, such that moving the shifting tool further in the first direction after contacting the at least one protruding feature of the STIM with the at least one flexible member of the shifting tool causes the at least one flexible member of the shifting tool to deflect radially inward.

10. The method of claim 9 wherein engaging the shifting tool and the STIM comprises moving the shifting tool even further in the first direction until the radially inward deflection of the at least one flexible member lessens as a result of engagement of the at least one flexible member of the shifting tool with the protruding feature of the STIM.

11. An apparatus, comprising:

a valve connected to a wellbore casing proximate a well zone and comprising:

a port for fluid communication along a flow path extending from the well zone into the casing through the port;

a filter moveable between a filtering position and a non-filtering position, wherein the filter is in the flow path when in the filtering position but not when in the non-filtering position, and wherein the filter comprises a first internal passage through which a shifting tool passes in downhole and uphole directions without engaging the filter; and a shifting tool interface member (STIM) adjacent an end of the filter and having a second internal passage engageable with the shifting tool, wherein engagement between the shifting tool and the internal passage of the STIM permits uphole motion of the shifting tool to be translated into uphole motion of the STIM, and wherein sufficient uphole motion of the STIM moves the STIM into engagement with the casing and, substantially simultaneously, out of engagement with the shifting tool.

12. The apparatus of claim 11 wherein:

the valve further comprises a sleeve moveable from a closed-port position to an open-port position;

uphole motion of the shifting tool, the STIM and the filter translates to uphole motion of the sleeve from the closed-port position to the open-port position;

the flow path is interrupted by the sleeve when the sleeve is in the closed-port position; and the sleeve comprises a third internal passage through which the shifting tool passes in downhole and uphole directions without engaging the sleeve.

13. The apparatus of claim 11 wherein:

the STIM comprises an engaging member moveable between a first position and a second position;

the engaging member protrudes from an inner profile of the STIM when in the first position;

the engaging member protrudes from an outer profile of the STIM when in the second position;

the engaging member is in the first position when the STIM is engaged with the shifting tool; and the engaging member is in the second position when the STIM is engaged with the casing.

14. The apparatus of claim 13 wherein the engaging member is recessed within the outer profile of the STIM when in the first position, and wherein the engaging member is recessed within the inner profile of the STIM when in the second position.

15. The apparatus of claim 13 wherein engagement of the shifting tool and the STIM comprises engagement between the shifting tool and the engaging member in the first position, and wherein engagement of the casing and the STIM comprises engagement between the casing and the engaging member in the second position.

16. The apparatus of claim 13 wherein the STIM substantially simultaneously moving into engagement with the casing and out of engagement with shifting tool comprises radial translation of the engaging member from the first position to the second position, whereby the shifting tool disengages the engaging member and, substantially simultaneously, the casing engages the engaging member.

17. The apparatus of claim 11 wherein:

the valve is one of a plurality of substantially similar valves associated the casing and each comprising an instance of the port, the filter and the STIM;

the casing is part of a completion system deployed in a multi-zone area of the wellbore; and the multi-zone area comprises a plurality of well zones that are each proximate a corresponding one or more of the plurality of valves.

18. The apparatus of claim 11 wherein the filter does not comprise a burst seal.

19. A method, comprising:

transitioning from a non-production operational mode of a wellsite to a production operational mode, wherein the wellsite comprises a wellbore intersecting a plurality of well zones, wherein at least a portion of the wellbore comprises a casing, wherein a plurality of valves associated with the casing each comprise a moveable member and a shifting tool interface member (STIM) each positioned in the casing, and wherein transitioning from the non-production operational mode of the wellsite to the production operational mode comprises:

(a) moving a shifting tool in a first direction through the moveable member and the STIM of each of the plurality of valves;

(b) moving the shifting tool in a second direction substantially opposite the first direction until the shifting tool and the STIM of the then most proximate valve engage;

(c) moving the shifting tool further in the second direction, thereby moving the engaged STIM and its associated moveable member in the second direction, until the engaged STIM substantially simultaneously:
disengages the shifting tool; and
engages the casing; and (d) repeating steps (b) and (c) at each successively encountered one of the plurality of valves as the shifting tool moves further in the second direction.

20. The method of claim 19 wherein the casing is part of a completion system deployed in the wellbore proximate the plurality of well zones, and wherein the plurality of well zones are each proximate a corresponding one or more of the plurality of valves.

* * * * *